US007932452B2

(12) United States Patent
Chen

(10) Patent No.: US 7,932,452 B2
(45) Date of Patent: Apr. 26, 2011

(54) EXTENDED LOW FREQUENCY RESONANT STRUCTURE FOR DRUMHEAD

(76) Inventor: Chang-Hui Chen, Taichung Hsien (TW)

( * ) Notice: Subject to any disclaimer, the term of this patent is extended or adjusted under 35 U.S.C. 154(b) by 90 days.

(21) Appl. No.: 12/535,716

(22) Filed: Aug. 5, 2009

(65) Prior Publication Data

US 2011/0030529 A1 Feb. 10, 2011

(51) Int. Cl.
*G10D 13/04* (2006.01)

(52) U.S. Cl. ..... 84/411 R

(58) Field of Classification Search ..... 84/411 R, 84/412, 420, 411 A, 421
See application file for complete search history.

(56) References Cited

U.S. PATENT DOCUMENTS 6,172,289 B1 * 1/2001 Shelley ..... 84/411 R
* cited by examiner

*Primary Examiner* — Kimberly R Lockett
(74) *Attorney, Agent, or Firm* — Leong C. Lei

(57) ABSTRACT

A drum fitted with drum heads features easy adjustment and variation of low-pitched sound. The drum head is formed with one or more openings to which surrounds made of material the same as or different than the drum head itself is attached for an independent and localized vibration area. Alternatively, the drum head is formed with a successively corrugated local area that offers localized deformation of the drum head. Either one of the constructions of the drum head provides the drum head with an independent and resiliently deformable local surface whereby when the drum is struck, the air contained inside the drum is pressurized to cause the vibration of the independent local surface, effectively increasing the vibration amplitude of the local surface on the drum head and thus extending the sound of the drum to a lower level.

6 Claims, 4 Drawing Sheets

EXTENDED LOW FREQUENCY RESONANT STRUCTURE FOR DRUMHEAD

(a) TECHNICAL FIELD OF THE INVENTION

The present invention generally relates to an extended low frequency resonant structure for a drumhead, wherein a membrane is first cut to form slits before secured to a shell and independent suspension rims are adhesively attached to the skin to cover the slits for providing a complete surface of the skin secured to the shell, whereby a drum skin having a localized resiliently-floating portion is formed so that when the drum is struck, air contained in the resonant chamber inside the shell is compressed to vibrate the skin and also to displace the localized resiliently-floating portion of the skin in such a way that the effective displacement of the drum skin is increased to extend the drum sound to lower frequencies and thus providing a drum of which the sound generated can be made louder and deeper by replacing the skin of one of the drum heads.

(b) DESCRIPTION OF THE PRIOR ART

The pitch of a musical instrument is greatly related to the circumferential size or depth of the body. This is especially true of a drum. In practical performances, to achieve different pitches, various circumferential sizes or depths of drums are needed. However, for nuances of pitch, drums of the same circumferential size and depth fitted with different drum heads will better serve the purpose.

SUMMARY OF THE INVENTION

In view of the shortcomings mentioned above that the nuances of the pitch of a conventional drum cannot be easily achieved, the present invention aims to provide extended low frequency for the drum by fitting it with drum heads, which contain at least one independently floating membrane made of the material same as or different from the drum head itself. The independently floating membrane is attached, normally with glue, to the cutaway area within the circumference of the drum head via curved surrounds of the material same as or different from the drum head itself. There could be more than one independently floating membrane attached to the same drum head. Their flexible and resilient nature allows the expansion of the resonance chamber formed inside the drum shell when the batter drum head is struck as the air inside the drum shell pushes the independently floating membrane(s) farther out than the drum head itself, hence extending the lower end of the frequency range. As such, a drummer is capable of obtaining lower frequency pitches of the same drum simply by fitting it with drum heads of the present invention.

The foregoing objective and summary provide only a brief introduction to the present invention. To frilly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
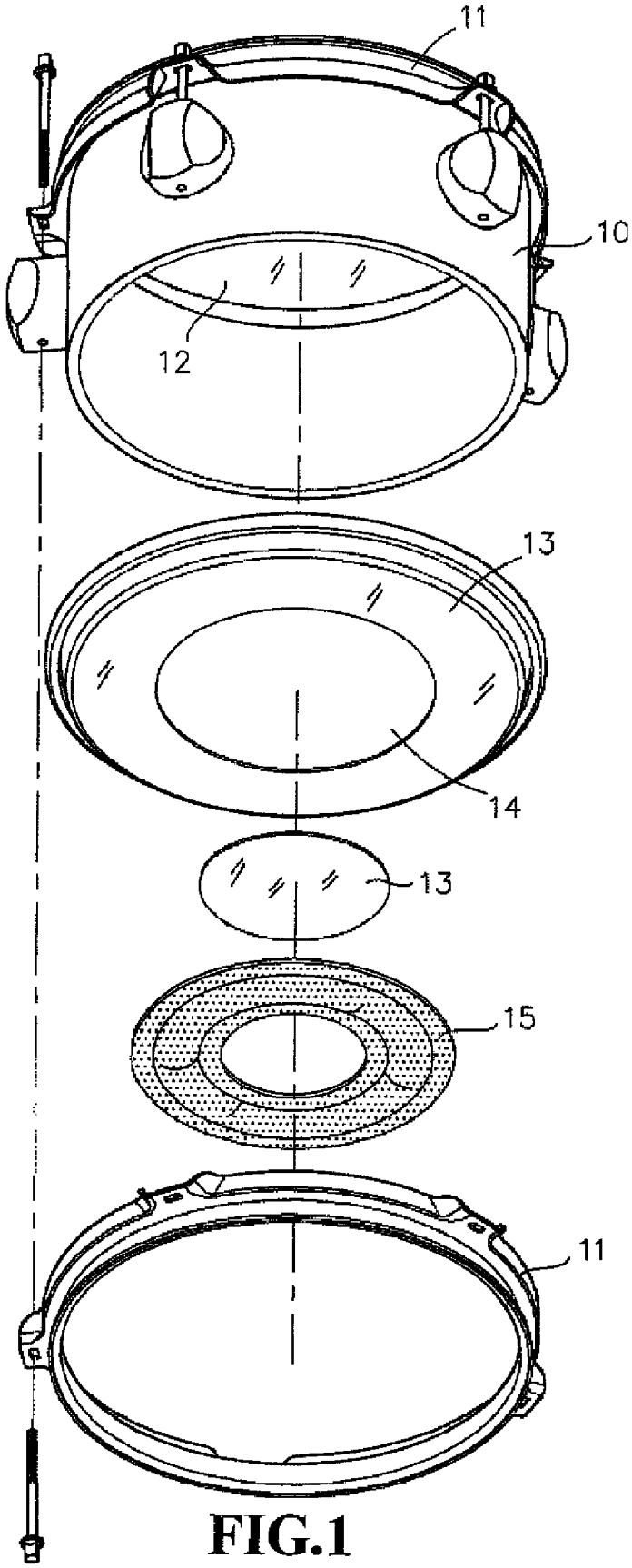
FIG. 1 is an exploded view of a drum fitted with a drum head constructed of an independently floating membrane in accordance with the present invention.
Figure 2:
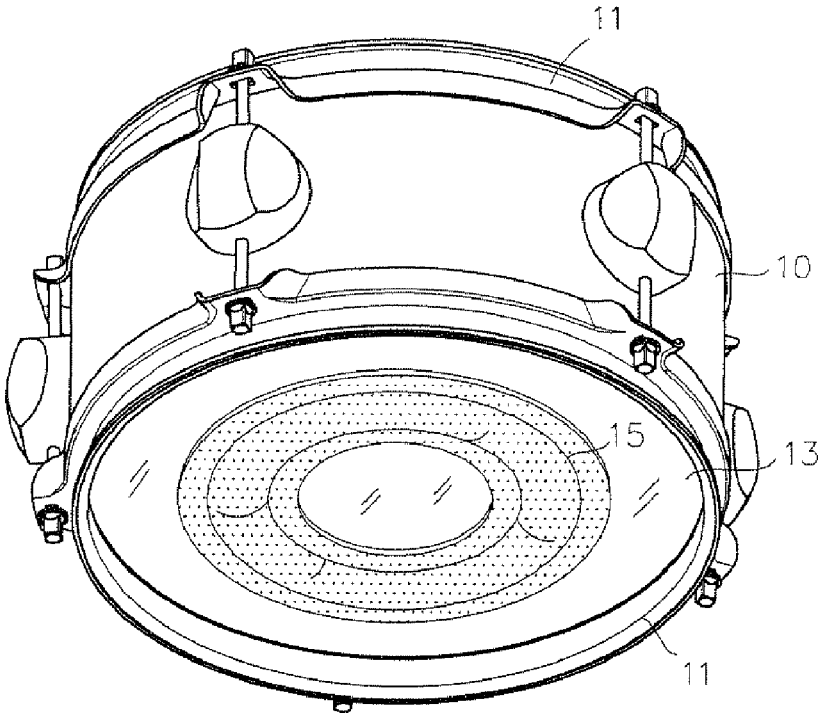
FIG. 2 is a perspective view of a drum fitted with a drum head of the present invention.
Figure 3:
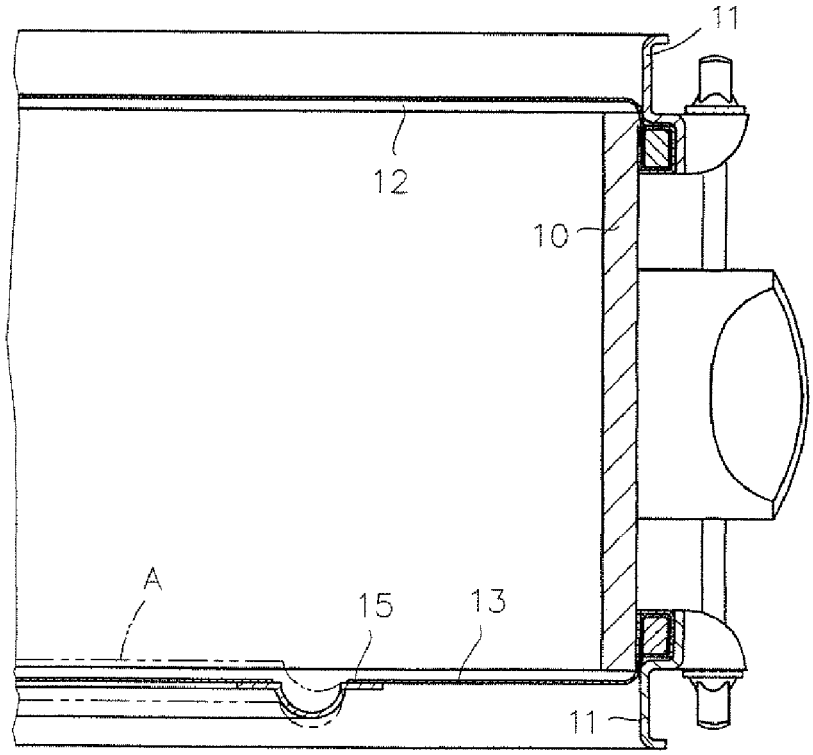
FIG. 3 is a cross-sectional view of a drum fitted with a drum head of the present invention.

The present invention provides a resonant structure of a drum head for extending the low frequency of the drum. As shown in FIGS. 1-3, a drum comprises a drum shell 10, which is normally cylindrical in the embodiment illustrated, and hoops 11 that secure a batter head 12 on the top side and a resonance head 13 on the bottom side for inducing resonance, which are made by properly shaping animal skins or composite materials, to opposite opening of the shell 10. The present invention features one or more opening 14 in one of the drum heads, preferably the resonance head 13. In other words, the openings 14 are formed in the shaped resonance head 13. In the space inside the opening 14, a suspension surround 15 that can be made of the material same as or different than the drum head is attached to the drum head, preferably by adhesion or other known means to provide a complete and unitary drum head. The drum head is then secured by the loop 11 to the shell 10 to serve as the resonance head 13. Due to the connection through the surround 15, a portion of the resonance head is in a free floating condition and is more flexible than the rest of the drum head. The surround 15 can be manufactured of various materials, such as non-woven fabric, foam, rubber, and paper, which are processed in advance to have a bend or properly curved configuration for connection between independently floating surface and the drum head main, thereby providing a resonance head 13 that is locally and resiliently expandable/retractable. With the feature of being locally free floating on the drum head, the resonance chamber inside the drum shell 10 can be properly expanded when the batter drum head is struck, whereby the sound frequency can be extended to a lower level. In other words, for drums of the same shell 10, one fitted with drum heads of the present invention can produce lower pitch sound than one fitted with conventional drum heads. Thus, through simple replacement with the resonance head 13 in accordance with the present invention, a practical arrangement for flexibly adjusting the sound generated by a drum can be realized.

Figure 4:
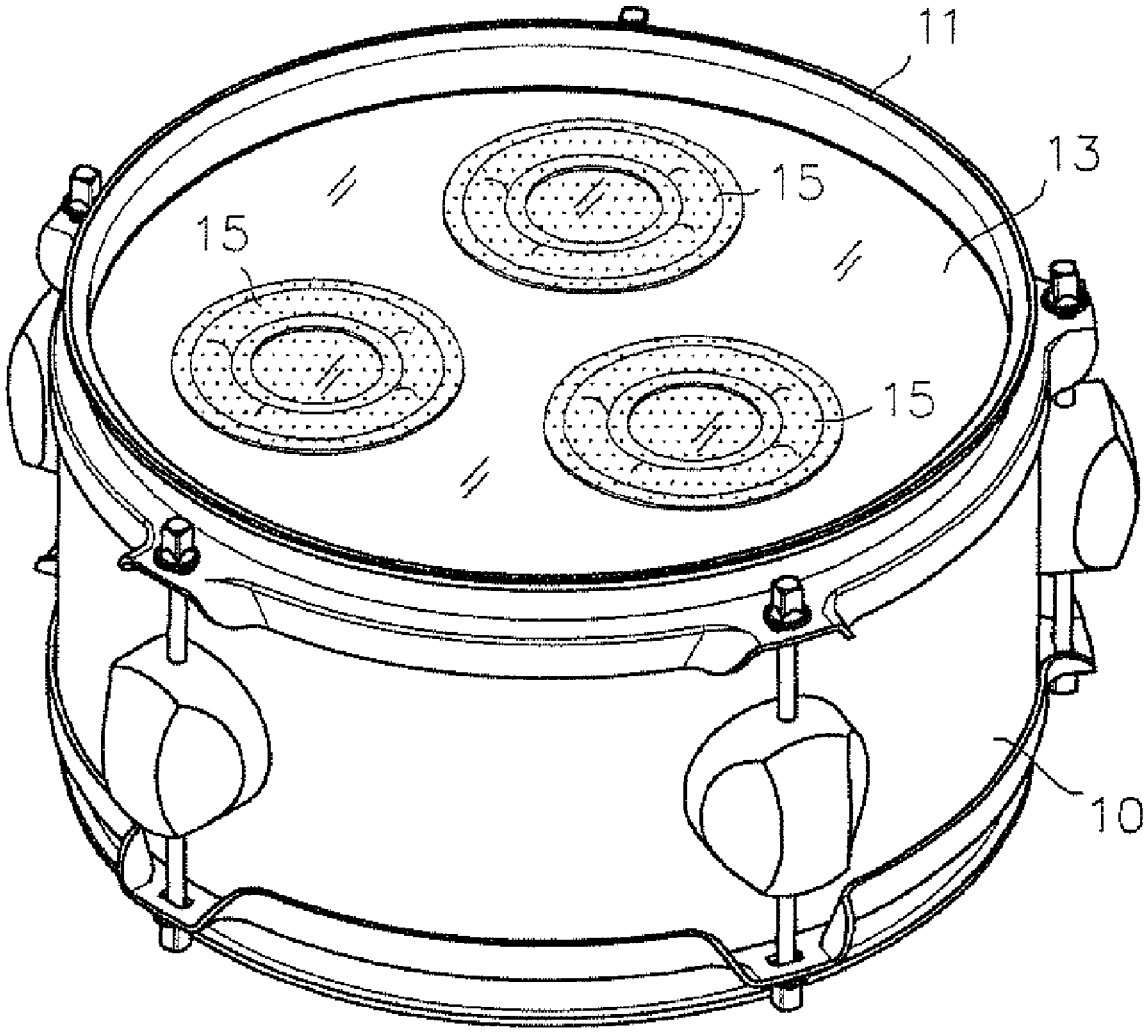
FIG. 4 is a perspective view of a drum fitted with a drum head constructed of more than one independently floating membrane in accordance with the present invention.
Figure 5:
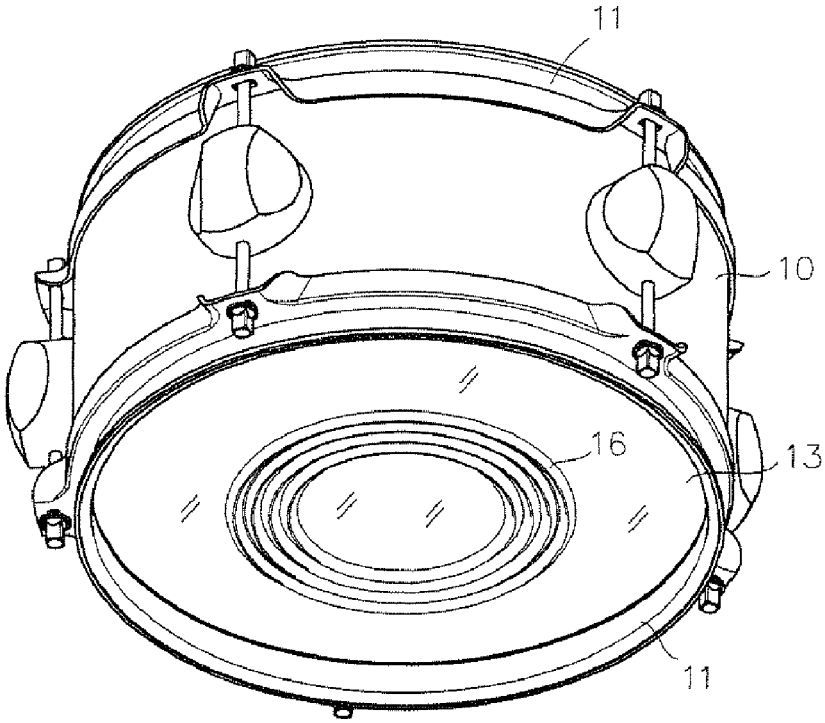
FIG. 5 is a perspective view of a drum fitted with a drum head constructed of a corrugated independently floating membrane in accordance with the present invention.
Figure 6:
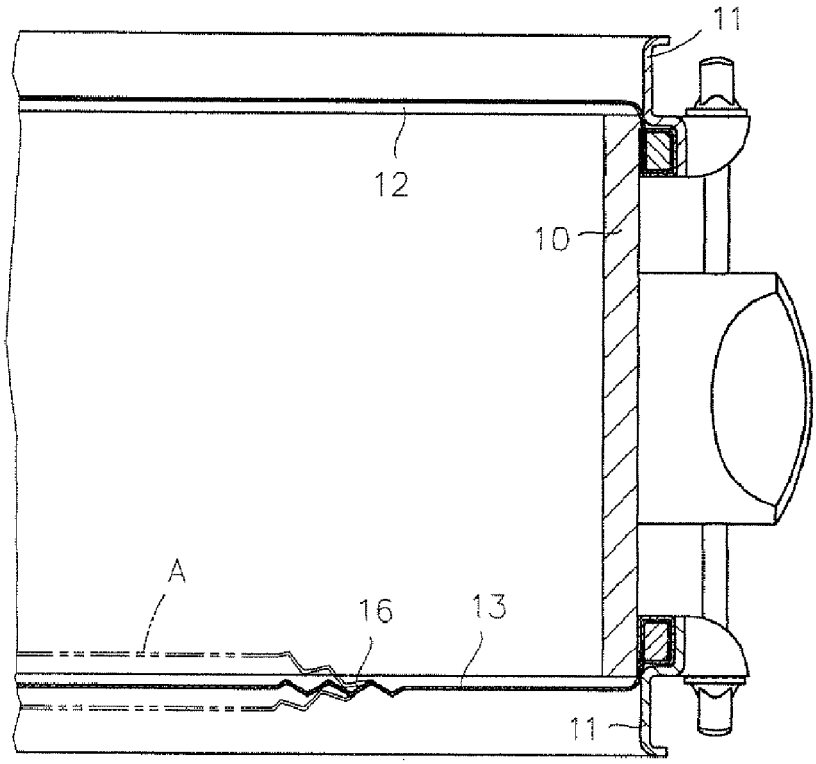
FIG. 6 is a cross-sectional view of the drum of FIG. 5 showing the drum head with a corrugated independently floating membrane.

In the drum pitch adjustment arrangement in accordance with the present invention, with the connection of the resilient surround 15 between the free floating surface and the drum head main, the amplitude of vibration of the resonance head 13 is increased, varying the volume of the air inside the resonance chamber of the shell. Due to the resilient and curved configuration of the surround 15, the drum head that is secured by the hoop provides a drum head structure that shows distribution of variable stretching. When the batter drum head is struck, air contained inside the shell 10 is subjected to the compression of drum head struck and induces pressurization, which makes the free floating portion of the drum head connected to the surround 15 extend further outward, as illustrated by the displacement indicated by "A". Due to the bulging of the drum head, the internal resonance volume is increased, significantly extending the frequency of drum to a lower level and thus converting it into a deeper sounding drum. With such a replacement of the drum head, a drum of the same shell 10 can produce various sounding effects. Further, the arrangement of the surround 15 can be varied. An example is shown in FIG. 4 that comprises a connection arrangement comprising a plurality of localized and independent small-area membranes in which a number of surrounds 15 are provided and spaced from each other to allow for resilient change of the volume of the resonance chamber of the shell and thus versatile change of the low-pitched sounding effect can be realized. Or alternatively, as shown in FIG. 5, when a drum head is shaped, a central ring portion is formed in advance to comprise a successively corrugated area 16, whereby the drum head surface comprises a localized resiliently expandable surface. In other words, through the unique corrugation 16 based resilient formation of the drum head surface realized on the same drum head, the drum head also possesses the features of resilient deformability that is offered by the connection arrangement of the surround 15. Thus, a drum may provide change and adjustment for low-pitched sound effect through the installation of variable numbers of surround 15 or corrugated area 16, and, consequently, change and adjustment of the drum sounding can be realized without modification made on the shell 10 itself, proving that the present invention is not only novel but practical in design.

As described above, the present invention provides an extended low frequency resonant structure for a drum, wherein a drum head is formed in such a way for additional connection with at least one surround thereon or forming resilient corrugation, both providing the drum head with a floating portion of the drum head surface that features localized resilient displaceability, whereby when the batter drum head is struck, the resonance drum head is caused to displace in a floating manner by the pressurization of the air inside the shell, increasing the resonance space to realize downward extension of the drum sound to a lower pitch and thus allowing the same drum to change the sound thereof for various low-pitched sounding effect. This makes the conversion of drum sound and set-up of a drum more convenient.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A drum comprising a shell having opposite open ends to which a batter head and a resonance head are secured, and at least one drum head, preferably the resonance head, fitted with at least one surround that acts as a resilient connection so as to provide the drum head with an independently and resiliently floating local area, whereby when the drum is struck, an air resonance space inside the shell will expand, allowing the drum sound to be extended to a lower level.

2. The drum head according to claim 1, wherein the drum head is fitted with one or a plurality of surrounds.

3. The drum head according to claim 1, wherein the surround is made of material selected from consisting of rubber, foam, paper, and non-woven fabric.

4. The drum head according to claim 1, wherein the surround is connected to an opening that is formed in the drum head.

5. A drum comprising a shell having opposite open ends to which a batter head and a resonance head are secured and a drum head being formed to comprise a successively-corrugated area at a concentrically central portion of the drum head, the corrugated area comprising a local portion of the drum head that provides a resilient surface, so as to provide the drum head with a local area having different excursion capability, whereby when the drum is struck, an air resonance space inside the shell will expand further out to achieve the change of sounding effect with the drum sound being extended to a lower level.

6. The drum according to claim 5, wherein the corrugated area comprises one or a plurality of corrugation rings.

* * * * *